US007088943B2

(12) United States Patent
Iikura et al.

(10) Patent No.: US 7,088,943 B2
(45) Date of Patent: Aug. 8, 2006

(54) IMAGE FORMING APPARATUS, APPARATUS FOR SUPPLYING TONER AND DEVELOPING APPARATUS USING THEREFOR

(75) Inventors: Kazuaki Iikura, Niigata (JP); Ichiro Kawahara, Niigata (JP); Kazunari Iizuka, Niigata (JP); Koichi Tanaka, Niigata (JP)

(73) Assignee: Fuji Xerox Co., Ltd, Tokyo (JP)

( * ) Notice: Subject to any disclaimer, the term of this patent is extended or adjusted under 35 U.S.C. 154(b) by 0 days.

(21) Appl. No.: 10/771,148

(22) Filed: Feb. 4, 2004

(65) Prior Publication Data

US 2004/0228660 A1 Nov. 18, 2004

(30) Foreign Application Priority Data

Mar. 19, 2003 (JP) ..... 2003-075194

(51) Int. Cl.
*G03G 15/08* (2006.01)

(52) U.S. Cl. ..... 399/260; 399/263

(58) Field of Classification Search ..... 399/110, 399/111, 260, 262, 263
See application file for complete search history.

(56) References Cited

U.S. PATENT DOCUMENTS

| | | | | |
|---|---|---|---|---|
| 4,133,458 | A * | 1/1979 | Budny | 222/228 |
| 4,347,299 | A * | 8/1982 | Ozawa et al. | 399/58 |
| 4,641,602 | A * | 2/1987 | Kasai | 399/260 |
| 6,067,431 | A * | 5/2000 | Bakker | 399/252 |
| 6,137,971 | A * | 10/2000 | Sasaki et al. | 399/106 |
| 6,266,505 | B1 * | 7/2001 | Ban et al. | 399/258 |
| 6,473,588 | B1 * | 10/2002 | Nakamura | 399/286 |
| 6,671,476 | B1 * | 12/2003 | Saiki | 399/111 |
| 2003/0118368 | A1 * | 6/2003 | Saito et al. | 399/111 |

FOREIGN PATENT DOCUMENTS

| | | | |
|---|---|---|---|
| JP | 56077866 | A * | 6/1981 |
| JP | 8-87165 | | 4/1996 |

* cited by examiner

*Primary Examiner*—Arthur T. Grimley
*Assistant Examiner*—Ryan Gleitz
(74) *Attorney, Agent, or Firm*—Morgan, Lewis & Bockius LLP

(57) ABSTRACT

Regulatory member having a groove formed therein is provided at area where toner storage chamber and toner stirring chamber are in communication with each other. A quantity of toner supplied from toner storage chamber to toner stirring chamber is regulated by rotating regulatory member. Groove is formed in regulatory member.

23 Claims, 9 Drawing Sheets

IMAGE FORMING APPARATUS, APPARATUS FOR SUPPLYING TONER AND DEVELOPING APPARATUS USING THEREFOR

BACKGROUND OF THE INVENTION

1. Field of the Invention

The present invention relates to an electrophotographic image forming apparatus, as well as to an apparatus for supplying a toner and a developing apparatus using therefor.

2. Description of the Related Art

A known developing apparatus of the image forming apparatus houses toner in a toner storage chamber and supplies the toner stored in the toner storage chamber to a development roller while agitating the toner with a plurality of stirring members (see JP-A-8-087165)

No limitations have been imposed on supply of toner from the toner storage chamber to the toner stirring chamber. When the toner is excessively supplied, the toner is clumping to decrease picture quality and to damage the rotary components by increasing load exerted thereon. Particularly, as described in JP-A-8-087165, when the toner storage chamber and the toner stirring chamber are arranged side by side with reference to a substantially perpendicular direction, the toner readily moves in a downward perpendicular direction.

SUMMARY OF THE INVENTION

It is an object of the present invention to prevent occurrence of a failure in picture quality and fracture of components.

According to first aspect of the invention, there is provided with an apparatus for supplying a toner, including: a toner storage chamber; a toner stirring chamber communicating with said toner storage chamber; and a regulatory member for regulating supply of said toner to said toner stirring chamber. Here, the toner storage chamber and the toner stirring chamber are not necessarily arranged side by side in perpendicular direction. Even when the toner storage chamber and the toner stirring chamber are arranged side by side in a horizontal direction, supply of toner from the toner storage chamber to the toner stirring chamber can be regulated.

The toner storage chamber and the toner stirring chamber are preferably in communication with each other by way of the toner supply path. The member for regulating supply of the toner (Hereinafter, referred as the regulatory member) is preferably provided in the vicinity of the port of the toner stirring chamber that remains in communication with the toner supply path. When supply of toner is stopped the regulatory member can prevent the toner from being supplied from the toner supply path.

The regulation member is preferably formed from a rotational member; e.g., a roller. A groove is formed in an outer peripheral surface of the regulatory member so that the supply of the toner is regulated.

When the groove is formed in the outer peripheral surface of the regulatory member, a rotary shaft of the regulatory member is preferably provided at a position lower than the highest portion of the toner stirring chamber. When the groove is situated higher than the rotary shaft of the regulatory member, the toner in the groove does not fall. The level of the toner of the toner stirring chamber (i.e., the highest level of toner) can be maintained in the vicinity of the rotary shaft, thereby preventing further supply of toner.

The regulatory member may be formed from an arbitrary material. If the regulatory member is formed from plastic, the regulatory member can be manufactured inexpensively. If the regulatory member is formed from metal, the durability of the regulatory member can be enhanced. The regulatory member may be rotated at a rotational speed of 100 rpm or less. The quantity of toner supplied during the rotational speed is 10 g/min or more. When the regulatory member is rotated at high speed, a toner is fused by slidable friction. However, the rotational speed of 100 rpm or less can prevent the toner from being fused by the slidable friction. If the quantity of toner supplied is set to 10 g/min or more while the regulatory member is rotated at the rotational speed of 100 rpm or less, the quantity of toner required for a ratio of black-and-white (e.g., solid black) can be ensured.

A second aspect of the present invention, there is provide with the apparatus according to the first aspect of the invention, wherein the toner storage chamber and the toner stirring chamber are in communication with each other by a toner supply path. As a result of the regulatory member and the toner supply paths being sealed with the sealing member in the manner mentioned above, leakage of toner, which would otherwise be caused when supply of toner is stopped, can be prevented, and supply of toner can be regulated more accurately.

The toner supply feeder is preferably further provided with a removing member for removing the toner adhering to the regulatory member. If the toner caught in, e.g., grooves of the regulatory member, still remain adhering to the regulatory member, a correct quantity of toner to the toner stirring chamber may not be supplied. When the toner adhering to the regulatory member is scraped by the removing member, the quantity of toner can be correctly supplied.

According to the third aspect of the present invention, there is provided with the development apparatus including: a housing; a toner storage chamber formed within the housing; a toner stirring chamber which is formed within the housing and remains in communication with the toner storage chamber; a development chamber which is formed within the hosing, is supplied with toner from the toner stirring chamber, and is equipped with a development roller; and regulatory member for regulating supply of toner to the toner stirring chamber. Preferably, a toner supply path is formed in the housing for bringing the toner storage chamber and the toner stirring chamber into communication with each other. Further, a scanning optical path through which light originating from an optical writing apparatus passes is preferably formed in a side of the toner supply chamber. Moreover, the regulatory member is preferably provided in the vicinity of a port of the toner stirring chamber communicating with the toner supply path.

Further, according to the fourth aspect of the invention, there is provided with an image forming apparatus having the development apparatus possessing the foregoing feature.

DESCRIPTION OF THE PREFERRED EMBODIMENTS

Embodiments of the present invention will now be described by reference to the drawings.

Figure 1:
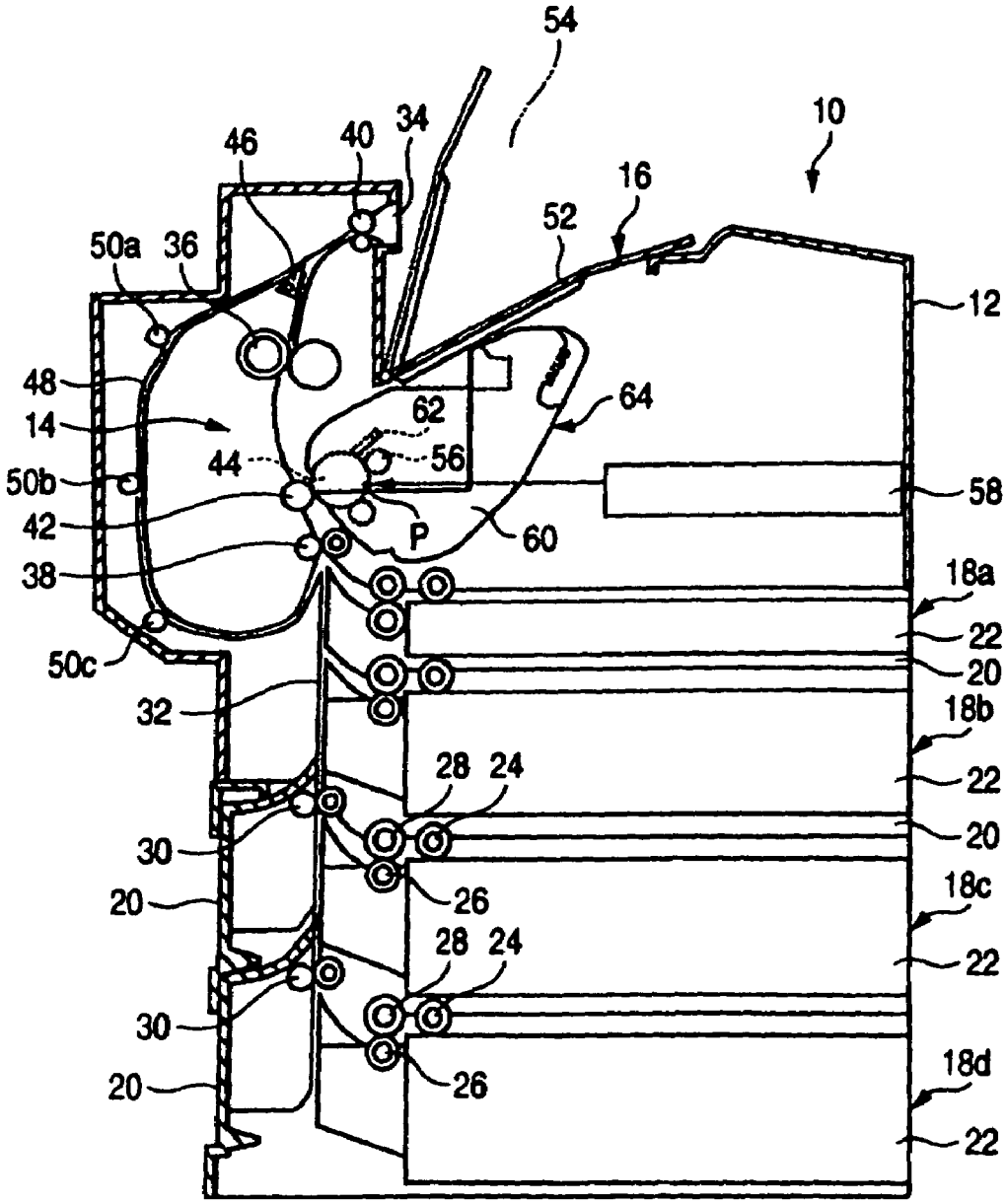
FIG. 1 is a cross-sectional view showing an image forming apparatus according to a first embodiment of the invention.

FIG. 1 shows the outline of an image forming apparatus 10 according to a first embodiment of the invention. The image forming apparatus 10 has an image forming apparatus main unit 12, and image formation member 14 is provided within the image forming apparatus main unit 12. An output section 16, which will be described later, is provided on top of the image forming apparatus main unit 12. For instance, two layers of paper feed units 18*a*, 18*b* are provided in a lower portion of the image forming apparatus main unit 12. Further, two layers of paper feed units 18*c*, 18*d* to be removably loaded are optionally provided in a further lower portion of the image forming apparatus main unit 12.

Each of the paper feed units 18*a* to 18*d* has a paper feed unit main body 20, and a paper feed cassette 22 into which a recording medium is to be housed. The paper feed cassette 22 is slidably loaded on the paper feed unit main body 20 and is drawn to the front (i.e., a rightward direction in FIG. 1). A pickup roller 24 is disposed at an upper position in the vicinity of the deepest end of the paper feed cassette 22. A retard roller 26 and a feed roller 28 are disposed rearward of the pickup roller 24. A pair of feed rollers 30 is provided for each of the optional paper feed units 18*c*, 18*d*.

A transfer path 32 is a recording medium passage extending from the pickup roller 24 of the paper feed unit 18*d* located at the bottom end to an output port 34. The transfer path 32 is located in the vicinity of a back surface (i.e., a left-side surface in FIG. 1) of the image forming apparatus main unit 12. the transfer path 32 is substantially formed along vertical direction so that the transfer path 32 extends from the feed roller 30 of the bottom end of the paper feed unit 18*d* to a fixing apparatus 36 to be described later. A transfer apparatus 42 and an image carrier 44, which will be described later, are disposed upstream of the fixing apparatus 36 of the transfer path 32. Further, a resist roller 38 is disposed upstream of the transfer apparatus 42 and the image carrier 44. Moreover, an output roller 40 is disposed in the vicinity of the output port 34 of the transfer path 32.

Consequently, a recording medium delivered from any one of the paper feed cassettes 22 of the paper feed units 18*a* to 18*d* by the pickup roller 24 is led to the transfer path 32 while being handled by the retard roller 26 and the feed roller 28. The recording medium is temporarily stopped by a resist roller 38 and passes between the transfer apparatus 42 and the image carrier 44, which will be described later, at a certain timing, whereupon developer image is transferred onto the recording medium. The thus-transferred developer image is fixed by the fixing apparatus 36, and the recording medium is output from the output port 34 to the output section 16 by the output roller 40.

However, in the case of double-sided printing operation, the recording medium is returned to a reverse path. Specifically, the portion of the transfer path 32 located forward of the output roller 40 is divided into two paths. A changeover member 46 (Hereinafter called a changeover lug 46) is provided at that divided area. There is formed a reverse path 48 that extends from the divided area and returns to the resist roller 38. Transfer rollers 50*a* to 50*c* are provided along the reverse path 48. In the case of double-sided printing, the changeover lug 46 is switched to a side where the reverse path 48 is to be opened. The output roller 40 is rotated in reverse at a point in time when the trailing edge of the recording medium comes into contact with the output roller 40, whereupon the recording medium is guided to the reverse path 48 and output from the output port 34 to the output section 16 after having passed through the resist roller 38, the transfer apparatus 42, the image carrier 44, and the fixing apparatus 36.

The output section 16 has a tapered section 52 which is rotational with respect to the image forming apparatus main unit. The tapered section 52 is tapered so as to become lower at an area thereof close to the output port and gradually higher toward the front (i.e., the rightward direction in FIG. 1). The area of the tapered section 52 located around the output port is taken as a lower end, and the higher end of the tapered section 52 is taken as an upper end. The tapered section 52 is supported on the image forming apparatus main unit 12 so as to be pivotable about the lower end. As indicated by a two-dot chain line in FIG. 1, when the tapered section 52 has been rotated upward and opened, an open section 54 is formed. A process cartridge 64, which will be described later, can be attached to and removed from the image forming apparatus main unit by the open section 54.

The image forming member 14 is of electrophotography type and, hence, includes the image carrier 44 formed from a photosensitive material; an electrostatic charger 56 formed from, e.g., an electrostatic charging roller for electrostatically charging the image carrier 44 uniformly; an optical writing apparatus 58 for writing, with light, a latent image on the image carrier 44 electrostatically charged by the electrostatic charger 56; a development apparatus 60 for visualizing, with toner, the latent image of the image carrier 44 formed by the optical writing apparatus 58; the transfer apparatus 42 which transfers the toner image formed by the development apparatus 60 onto the recording medium and is constituted of, e.g., a transfer roller; a cleaning device 62 which cleans the toner remaining on the image carrier 44 and is constituted of, e.g., a blade; and the fixing apparatus 36 constituted of, e.g., a pressure roller and a heating roller, for fixing on the recording medium the toner image transferred onto the same by the transfer apparatus 42. The optical writing apparatus 58 has, e.g., a scanning laser exposure system, and is arranged in the vicinity of the front surface of the image forming apparatus main unit 12 in parallel with the foregoing paper feed units 18*a* to 18*d*. As will be described later, the image carrier 44 is exposed such that the optical writing apparatus 58 travels across the development apparatus 60. The position where the image carrier 44 is exposed is taken as a latent image writing position P. Although in the embodiment the scanning laser exposure system is used as the optical writing apparatus 58, an LED, surface emitting laser, or the like can be used in another embodiment.

The process cartridge 64 is an integration of the image carrier 44, the electrostatic charger 54, the development apparatus 60, and the cleaning device 62. The process cartridge 64 is disposed at a position immediately below the tapered section 52 of the output section 16. As mentioned previously, the process cartridge 64 is removably attached by way of the open section 54 formed when the tapered section 52 is opened.

Figure 2:
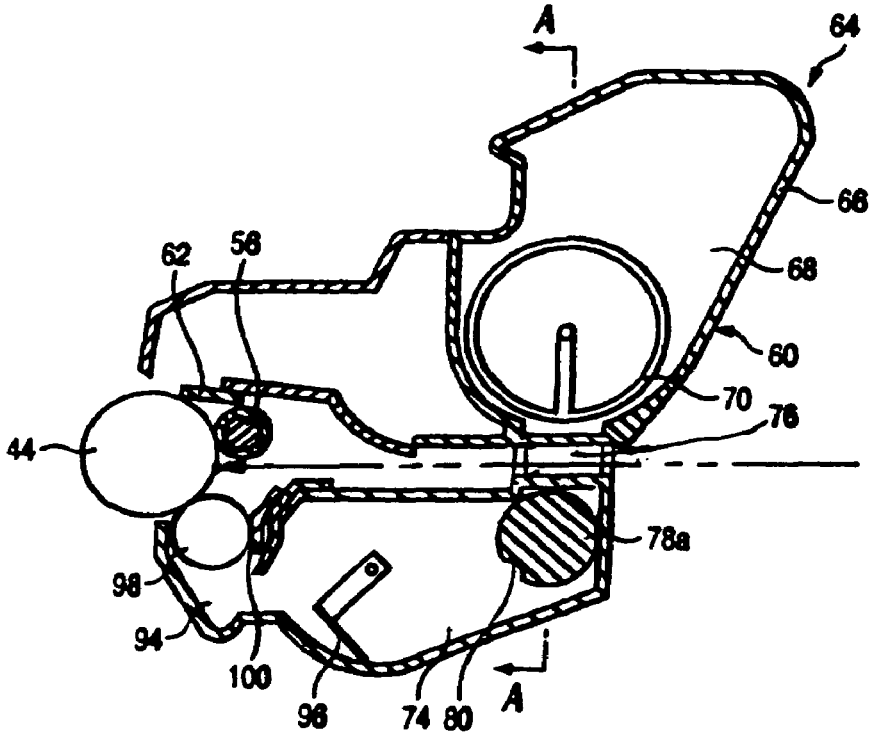
FIG. 2 is a cross-sectional view showing a process cartridge of the first embodiment.
Figure 3:
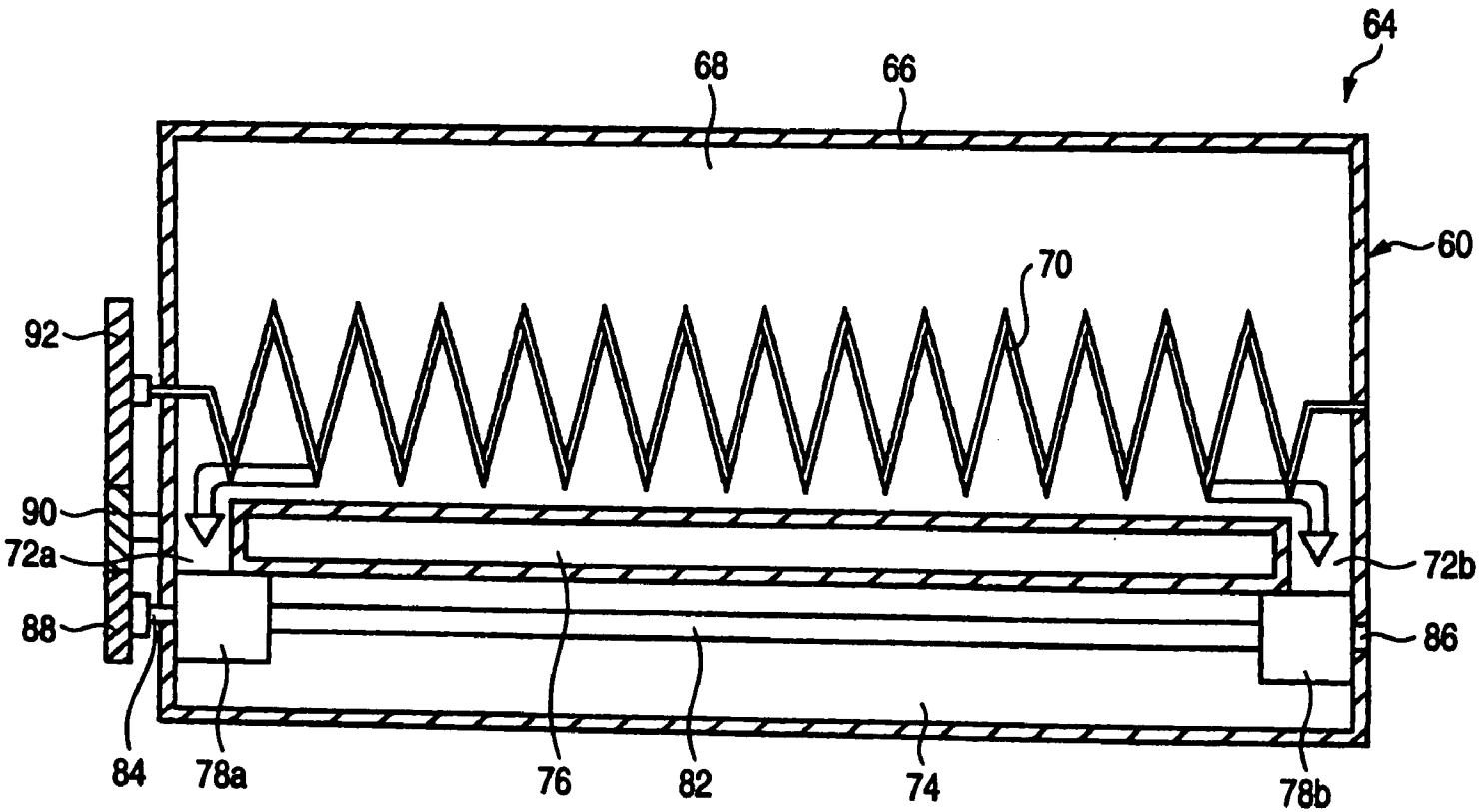
FIG. 3 is a cross-sectional view taken along line A—A shown in FIG. 2, showing the process cartridge of the first embodiment.

FIGS. 2 and 3 show details of the previously-mentioned process cartridge 64. The development apparatus 60 of the process cartridge 64 has a housing 66 extending in vertical and horizontal directions. A toner storage chamber 68 is formed in an upper inner portion of the housing 66, and toner is housed in the toner storage chamber 68. The toner storage chamber 68 is provided with a first stirring member 70 for agitating and conveying toner. The first toner stirring member 70 has, e.g., a wire member formed in a helical pattern. The first toner stirring member 70 is for stirring and transporting the toner in the toner storage chamber 68 in a horizontal direction and is formed such that, for instance, the winding direction of a spiral changes from the center to the right and left.

Right and left ends of the toner storage chamber 68 are in communication with a toner stirring chamber 74 formed at a position below the housing 66, by way of toner supply paths 72*a*, 72*b* formed in the housing 66. The toner transported to the right and left of the toner storage chamber 68 from the first toner stirring member 70 falls into a toner stirring chamber 74 by way of the toner supply paths 72*a*, 72*b*. In the housing 66, a scanning optical path 76 is formed laterally adjacent to the toner supply paths 72*a*, 72*b*; that is, in a space between the toner supply paths 72*a*, 72*b*. The light originating from the previously-described optical writing apparatus 58 passes through the housing 66 by way of the scanning optical path 76.

Figure 4:
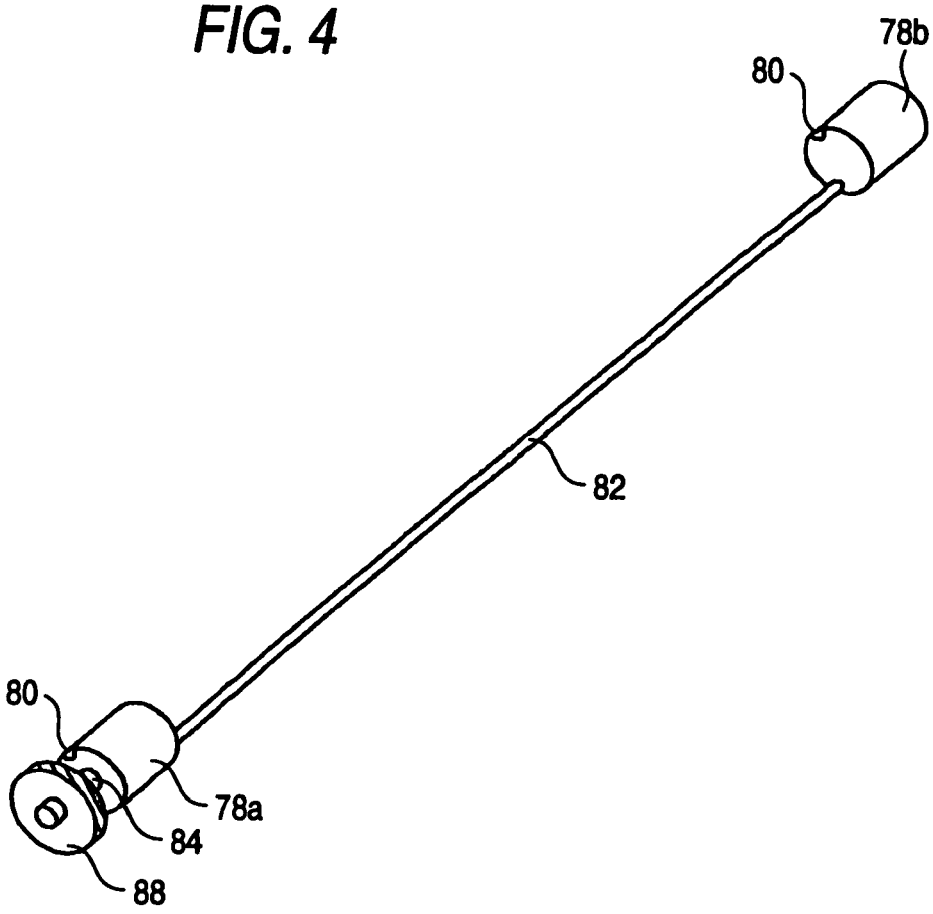
FIG. 4 is a perspective view showing a regulatory member and a second stirring member, which are used in the process cartridge of the first embodiment.
Figure 5:
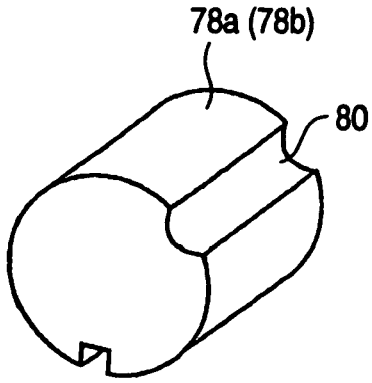
FIG. 5 is an enlarged perspective view showing the regulatory member used in the process cartridge of the first embodiment.

Regulatory members 78*a*, 78*b* are formed from, e.g., plastic or metal, and disposed in the vicinity of areas of the toner stirring chamber 74 which remain in communication with the toner supply paths 72*a*, 72*b*. As shown in FIGS. 4 and 5, each of the regulatory members 78*a*, 78*b* is formed in the shape of a roller. Outer peripheral surfaces of the regulatory members 78*a*, 78*b* remain in contact with the housing 66 by way of the communication ports of the toner supply paths 72*a*, 72*b*, thereby sealing the communication port.

Grooves 80 formed in, e.g., a semi-circular shape, are axially formed in the outer peripheral surfaces of the regulatory members 78*a*, 78*b*. One groove 80 is provided in the present embodiment, but may have a plurality of grooves. Moreover, the regulator members 78*a*, 78*b* are connected together by way of a second stirring member 82. The second stirring member 82 is connected to the regulatory members 78*a*, 78*b* in the vicinity of the outer peripheral surfaces of the regulatory members 78*a*, 78*b*. As a result of rotating in conjunction with the regulatory members 78*a*, 78*b*, the second stirring member 82 gathers the toner to the center and horizontally disperses the same, thereby transporting the toner back downstream.

A rotary shaft 84 is provided at the center on the side of the regulatory member 78*a* opposite the stirring member 82, and a support shaft 86 is provided at the center on the side of the regulatory member 78*b* opposite the stirring member. The regulatory members 78*a*, 78*b* and the second regulatory member 82 are rotatively supported by the rotary shaft 84 and the support shaft 86 on the housing 66. The rotary shaft 84 protrudes from the housing 66 to the outside and is coupled to a first gear 88. The first gear 88 meshes with a third gear 92 via a second gear 90 serving as an idle gear. The third gear 92 is coupled to the first stirring member 70. A driving gear which rotates in conjunction with a motor is coupled with any one of the gears 88 to 92. As a result, the first stirring member 70, the regulatory members 78*a*, 78*b*, and the second stirring member 82 rotate synchronously. The rotary shaft 84 of the regulatory members 78*a*, 78*b* are situated at the highest position on the toner stirring chamber 74; that is, at positions which are lower than the ceiling of the housing 66 constituting the toner stirring chamber 74 by essentially a half the diameter of the regulatory members 78*a*, 78*b*.

The regulatory members 78*a*, 78*b* preferably rotate at a rotational speed of 100 rpm or less, and the quantity of toner supplied is preferably 10 g/min or more. The regulatory members 78*a*, 78*b* may be rotated sequentially or intermittently.

A development chamber 94 is formed on the part of the housing 66 opposing the image carrier so as to communicate with the toner stirring chamber 74. The toner stirring chamber 74 is provided with a third stirring member 96, and the toner is supplied to the development chamber 92 by the third stirring member 96.

A development roller 98 is arranged in the development chamber 94. The development roller 98 is embodied by wrapping a sleeve around a magnet roller. A member 100 for regulating a thickness of the toner (hereinafter called a layer thickness regulatory member 100) is formed from, e.g., resin, remains in contact with the development roller 98. The layer thickness regulatory member 100 regulates the thickness of toner adhering to the surface of the development roller 98. The development roller 98 opposes the image carrier 44, and the toner transported by the development roller 98 is supplied to the image carrier 44.

Another stirring member may be provided in the development chamber 94 or at positions where the toner stirring chamber 74 is in communication with the development chamber 94, thereby supplying toner to the development roller 98.

Operation of the embodiment will now be described.

The image carrier 44 is uniformly charged by the electrostatic charger 56. The light originating from the optical writing apparatus 58 on the basis of an image signal is radiated on the thus-charged image carrier 44, and a latent image is formed at the latent image writing position P. The light originating from the optical writing apparatus 58 passes through the inside of the development apparatus 60 via the optical scanning path 76 of the development apparatus 60. The latent image on the image carrier 44 formed by the optical writing apparatus 58 is visualized with toner of the development apparatus 60.

The toner housed in the toner storage chamber 68 is transported to both sides of the first stirring member 70 by rotating the first stirring member 70. The transported toner tends to fall to the toner stirring chamber 74 situated at a lower position via the toner supply paths 72*a*, 72*b*. Here, the regulatory members 78*a*, 78*b* are arranged in the vicinity of the ports of the toner stirring chamber 74 that remain in communication with the toner supply paths 72*a*, 72*b*. When the grooves 80 of the respective regulatory members 78*a*, 78*b* are opened in the toner supply paths 72*a*, 72*b*, the toner enters the grooves 80. When the grooves 80 of the regulatory members 78*a*, 78*b* are caused to face downward of the toner stirring chamber 74 by rotation of the regulatory members

78*a*, 78*b*, the toner falls and is supplied to the toner stirring chamber 74. When the grooves 80 of the regulatory members 78*a*, 78*b* are not opened in the toner supply paths 72*a*, 72*b*; that is, when the communication ports are sealed with the outer circumferential surfaces of the regulatory members 78*a*, 78*b*, supply of toner to the toner stirring chamber 74 is stopped.

Therefore, the quantity of toner supplied can be regulated in accordance with the shape and number of the grooves 80 formed in the respective regulatory members 78*a*, 78*b* and the number of rotations of the regulatory members 78*a*, 78*b*. As mentioned previously, the regulatory members 78*a*, 78*b* are rotated at a rotational speed of 100 rpm or less. The quantity of toner supplied at this time can be set to 10 g/min or more. When the regulatory members 78*a*, 78*b* are rotated at high speed, the toner maybe fused by slidable friction. Fusion of toner, which would otherwise be caused by such slidable friction, can be prevented by setting the rotational speed of the regulatory members 78*a*, 78*b* to 100 rpm or less. Moreover, if the quantity of toner supplied at this time is set to 10 g/min or more, the quantity of toner required for high-duty printing (e.g., solid black) can be ensured.

At the position where the grooves 80 of the regulatory members 78*a*, 78*b* are located higher than the rotary shaft 86, the toner caught in the grooves 80 does not fall to the toner stirring chamber 74. The toner of the grooves 80 falls to the toner stirring chamber 74 only after the grooves 80 have rotated to a position lower than the rotary shaft 86. Therefore, the level of the toner in the toner stirring chamber 74 can be stopped in the vicinity of the rotary shaft 86, thereby preventing any further supply of toner.

The toner that has been regulated by the regulatory members 78*a*, 78*b* and supplied to the toner stirring chamber 74 is stirred by the second toner stirring member 82 and further by the third stirring member 96. The toner is then transported to the development chamber 94. The toner transported to the development chamber 94 is supplied to the development roller 98, and the thickness of a toner layer is regulated by the layer thickness regulatory member 100. The toner is then supplied to the image carrier 44.

One of the paper feed units 18*a* to 18*d* is selected by a size signal or the like. The recording medium stored in any one of the paper feed cassettes 22 is fed by the pickup roller 24 and handled by the retard roller 26 and the feed roller 28 and then guided to the transport path 32. The recording medium is temporarily stopped by the resist roller 38 and guided between the transfer apparatus 42 and the image carrier 44 at a certain timing.

When the recording medium has been guided between the transfer apparatus 42 and the image carrier 44 in the manner mentioned previously, the toner on the image carrier 44 is transferred to the recording medium by the transfer apparatus 42. The recording medium on which toner has been transferred is output from the output port 34 to the output section 16 by way of the fixing apparatus 36.

Figure 6:
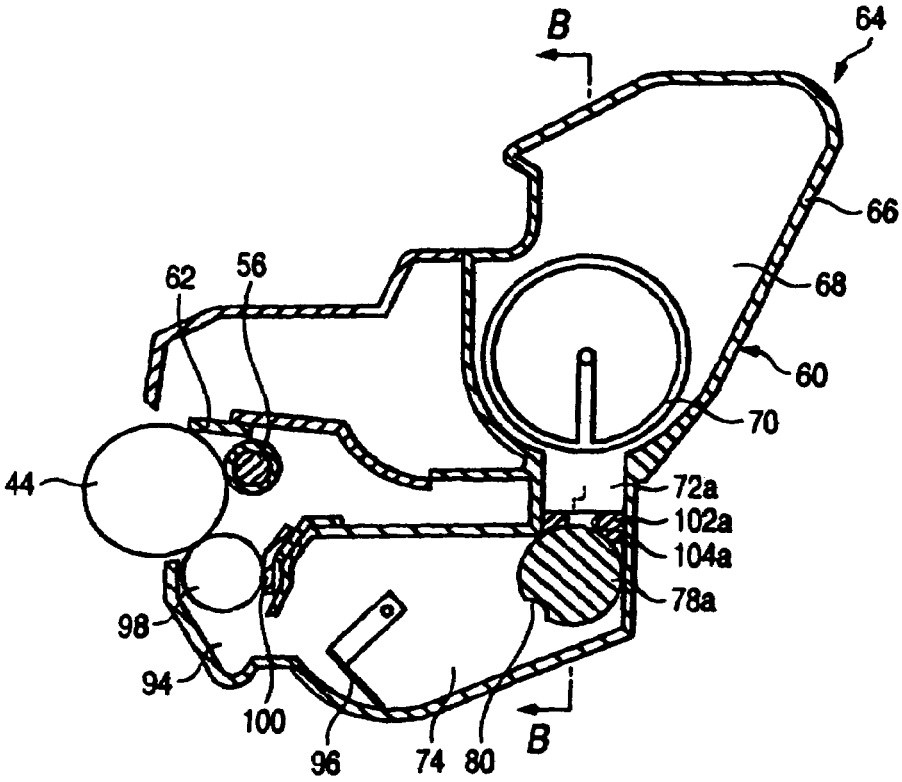
FIG. 6 is a cross-sectional view showing a process cartridge according to a second embodiment of the invention.
Figure 7:
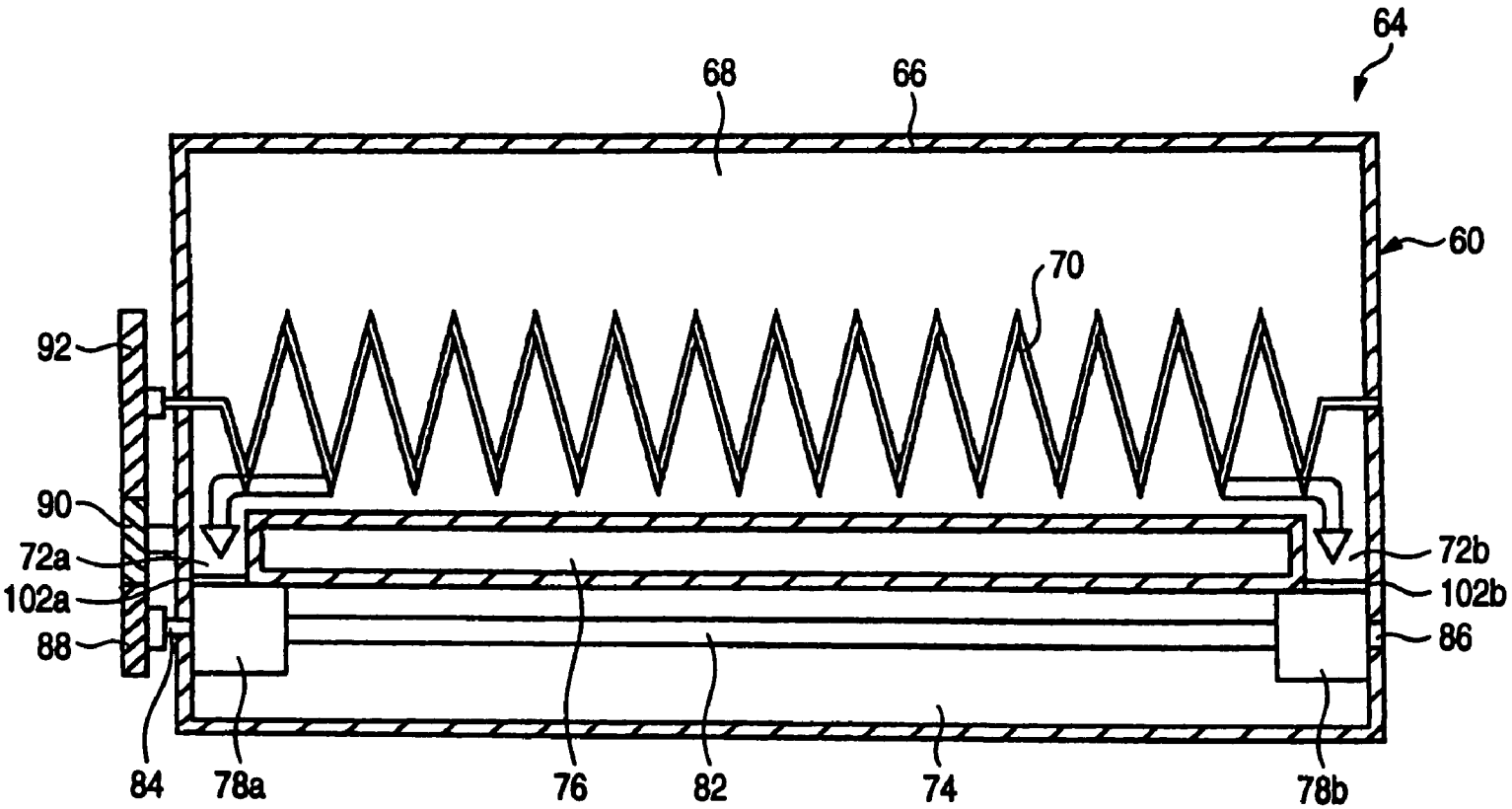
FIG. 7 is a cross-sectional view taken along line B—B shown in FIG. 4, showing the process cartridge of the second embodiment.

FIGS. 6 and 7 show the process cartridge 64 according to a second embodiment of the present invention. The second embodiment differs from the first embodiment in that sealing members 102*a*, 102*b* are provided between the toner supply paths 72*a*, 72*b* and the regulatory members 78*a*, 78*b*. The sealing members 102*a*, 102*b* are preferably chemical products; e.g., urethane foam, felt, or rubber, which are generally used as sealing material. The sealing members 102*a*, 102*b* assume essentially the same cross-sectional profile as that of the toner supply paths 72*a*, 72*b* and are fixed on the housing 66. Lower surfaces of the sealing members 102*a*, 102*b* are elastically deformed to come into contact with the regulatory members 78*a*, 78*b*. Through holes 104*a*, 104*b* are formed in the sealing members 102*a*, 102*b*, and the toner supply paths 72*a*, 72*b* come into communication with the grooves 80 of the regulatory members 78*a*, 78*b* via the through holes 104*a*, 104*b*.

Consequently, only when the grooves 80 are opened to the through holes 104*a*, 104*b* of the sealing members 102*a*, 102*b* as a result of rotation of the regulatory members 78*a*, 78*b*, the toner is supplied from the toner storage chamber 68 to the toner stirring chamber 74. In all other cases, the toner supply ports 72*a*, 72*b* are sealed with the sealing members 102*a*, 102*b*, and hence supply of toner can be stopped, thereby regulating supply of toner.

On the occasion of explanation of the second embodiment, those elements which are the same as those of the first embodiment are assigned the same reference numerals, and their explanations are omitted.

Figure 8:
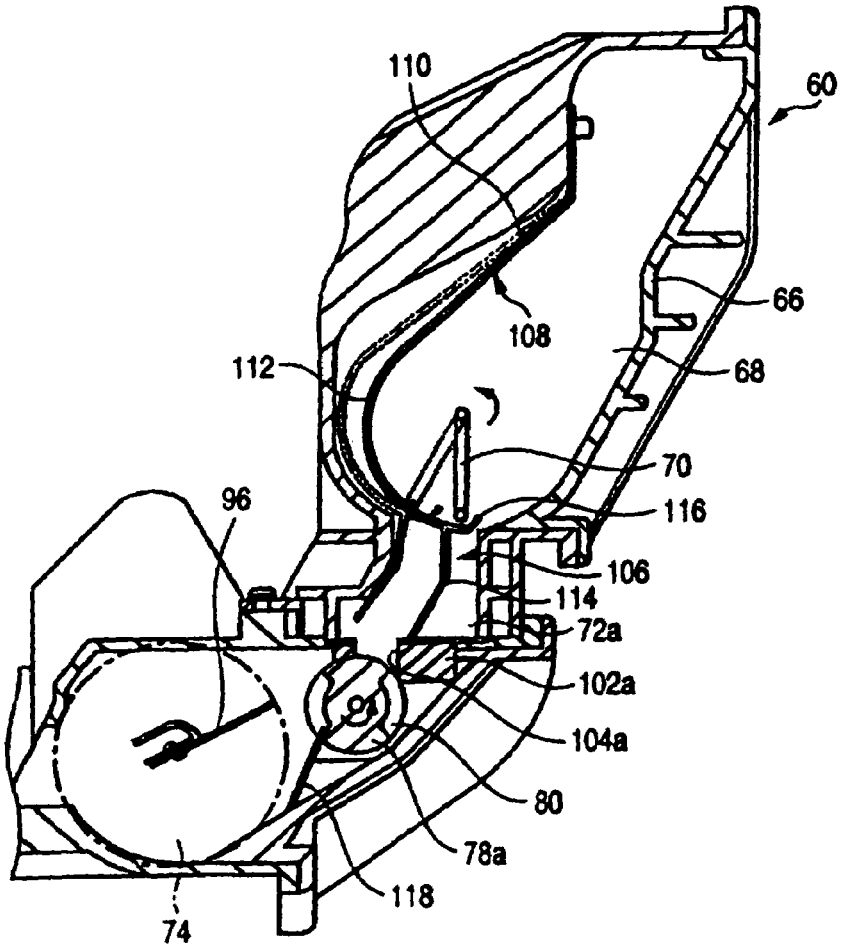
FIG. 8 is a cross-sectional view showing a development apparatus according to a third embodiment of the invention.
Figure 9:
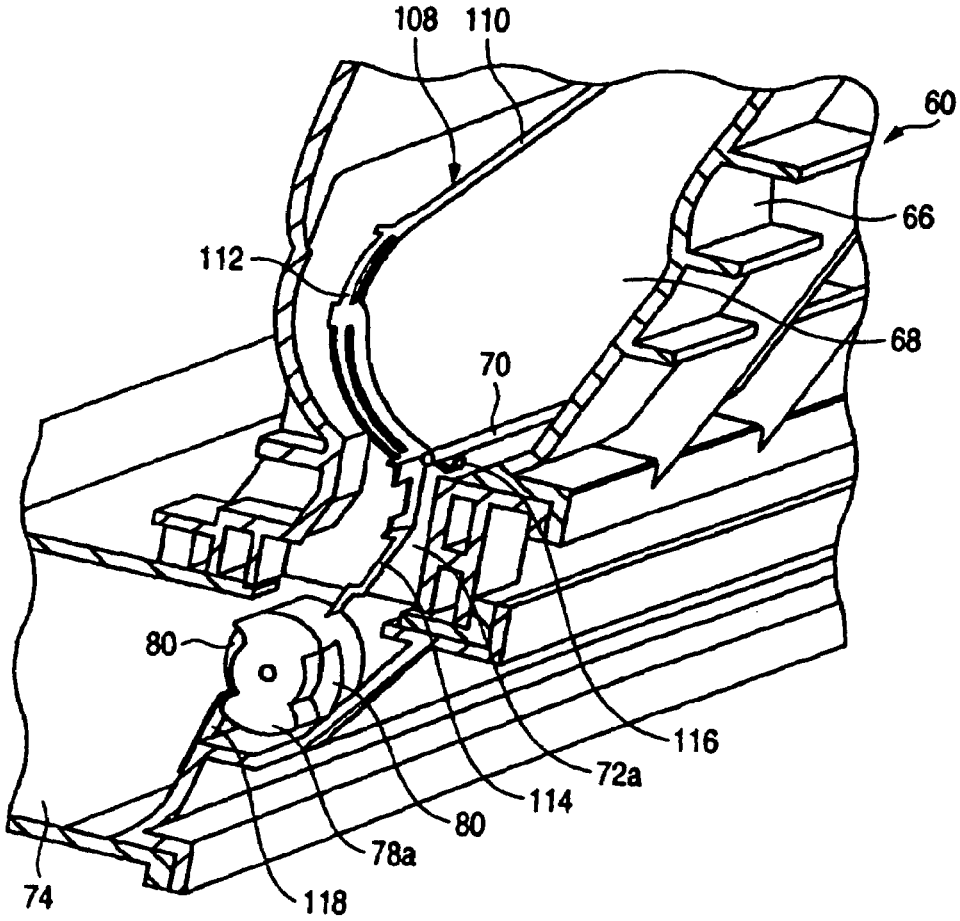
FIG. 9 is a cross-sectional view showing a development apparatus according to a third embodiment of the invention.

FIGS. 8 and 9 show the development apparatus 60 according to a third embodiment of the invention. In the third embodiment, the development apparatus 60 is provided with a stirring mechanism 106 to prevent the toner from clumping, which would otherwise be caused by the toner supply paths 72*a*, 72*b*. This stirring mechanism 106 has a fourth stirring member 108 formed from, e.g., thin metal (e.g., stainless steel) having elasticity. The fourth stirring member 108 is arranged to agitate, in conjunction with the first stirring member 70, the toner which is likely to coagulate within the toner supply paths 72*a*, 72*b*.

Specifically, the fourth stirring member 108 comprises a connection section 110 which is fixed at an upper end thereof to the housing 66 and formed linearly so as to extend downward while slightly departing from a wall surface of the housing 66; a pressed section 112 formed in a semicircular shape so as to extend downward from the linear section 110; a stirring section 114 which extends downward from the pressed section 112 and is arranged in the toner supply paths 72*a*, 72*b*; and a latch section 116 formed at the extremity of the pressed section 112. The first stirring member 70 is formed in the form of a crank. The rotational center of the first stirring member 70 is situated closer to the fourth stirring member 108 than to the center of the pressed section 112. Consequently, when the first stirring member 70 has rotated, the first stirring member 70 first comes into contact with the connection section 110, thereby pressing the pressed section 112 while traveling along the same. As a result, the stirring section 114 moves from a position indicated by a solid line to a position indicated by a two-dot chain line in FIG. 8. When the first stirring member 70 has rotated further, the restoration force for returning to the original position acts on the fourth stirring member 108. The latch section 116 is latched by the first stirring member 70, whereupon the fourth stirring member 108 returns to the original position. As mentioned above, the stirring section 114 of the fourth stirring member 108 moves back and forth within the toner supply paths 72*a*, 72*b* (particularly in the vicinity of the through holes 104*a*, 104*b* of the sealing members 102*a*, 102*b*), thereby agitating the toner in the toner supply paths 72*a*, 72*b*. Thus, the toner is smoothly supplied from the toner supply paths 72*a*, 72*b* to the toner stirring chamber 74.

In the third embodiment, two indented grooves 80 are formed in a side section of each of the regulatory members 78*a*, 78*b* while being separated from each other by, e.g., 180. The development apparatus is further provided with a removing member 118 for scraping out the toner having entered the grooves 80.

Specifically, the removing member 118 is formed from an elastic material, such as (trade name) One end of the removing member 118 is fixed to the housing 66 within the toner stirring chamber 74, and the other end of the same extends toward the regulatory members 78*a*, 78*b* so as to enter the grooves 80 of the regulatory members 78*a*, 78*b*. The only requirement for the extremity of the removing member 118 is to enter the grooves 80 at least. The extremity of the removing member 118 does not need to come into contact with the bottom of the grooves 80. The removing member 118 is situated so as to avoid a circular locus described by the extremity of the third stirring member 96.

Consequently, when the regulatory members 78*a*, 78*b* rotate counterclockwise in, e.g., FIG. 8, the extremity of the removing member 118 enters the grooves 80 every time the grooves 80 come to the position of the removing member 118. Consequently, the toner caught in the grooves 80 of the regulatory members 78*a*, 78*b* is scraped by the removing member 118. Consequently, the correct quantity of toner can be supplied from the toner storage chamber 68 to the toner stirring chamber 74.

On the occasion of explanation of the third embodiment, those elements which are the same as those of the first and second embodiments are assigned the same reference numerals, and their explanations are omitted.

Figure 10:
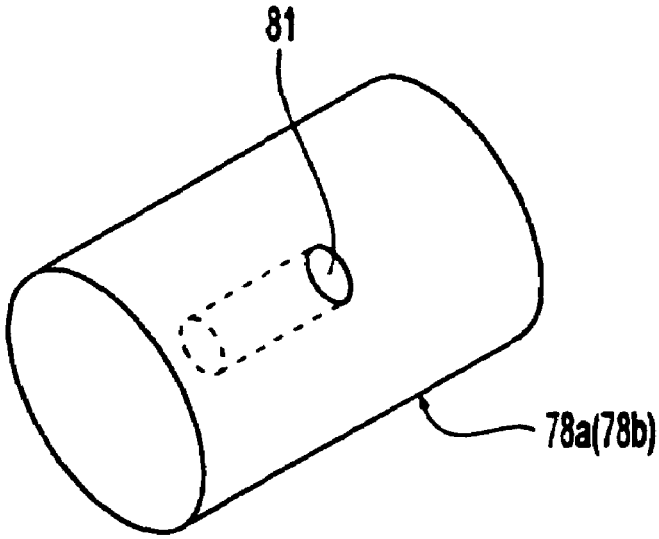
FIG. 10 is a detail of the regulatory member of FIG. 5 with an opening.
Figure 11:
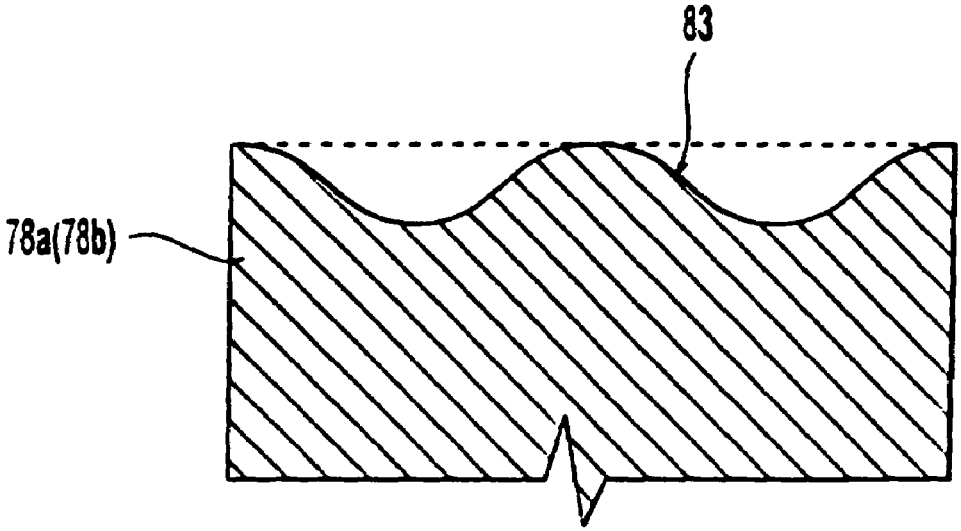
FIG. 11 is a detail of a cross-section of an irregular surface of the regulatory member of FIG. 5

In the first through third embodiments, the grooves 80 are formed in the regulatory members 78*a*, 78*b*, and thereby regulating supply of toner. However, the embodiments are not limited to the grooves 80. For instance, as shown in FIG. 10, the regulatory member 78*a* , 78*b* may have an opening 81 communicating the toner storage chamber with the toner stirring chamber. The regulatory member may have 78*a* , 78*b* may have an irregular surface 83 as shown in the cross-sectional detail taken along an axial direction of the regulatory members 78*a* , 78*b* shown in FIG. 11. The cross-sectional would be the same for a circumferential section except for the curvature of the regulatory members 78*a* , 78*b*. In the third embodiment, the removing member 118 is arranged to enter the grooves 80. However, the embodiment is not limited to such an arrangement. When the regulatory members 78*a*, 78*b* are provided with, e.g., irregular surfaces, the toner adhering to the regulatory members 78*a*, 78*b* may be merely removed by scraping out.

As mentioned previously, according to the invention, there is provided regulatory means for regulating supply of toner from a toner storage chamber to a toner stirring chamber. Hence, occurrence of a failure in picture quality or fracture of components can be prevented.

What is claimed is:

1. An apparatus for supplying a toner, comprising:

a toner storage chamber;

a toner stirring chamber communicating with said toner storage chamber;

a rotating stirring member disposed in said toner stirring chamber; and a regulatory member disposed in said toner stirring chamber for regulating supply of said toner to said toner stirring chamber;

the toner stirring chamber being connectable to a distinct development chamber;

wherein said toner storage chamber, said toner stirring chamber, and a toner supply path from said toner storage chamber to said toner stirring chamber are arranged to provide a scanning optical path.

2. The apparatus according to claim 1, wherein said regulatory member is provided in a vicinity of a port of said toner stirring chamber for communicating with said toner supply path.

3. The apparatus according to claim 1, wherein said regulatory member has a rotational member.

4. The apparatus according to claim 3, wherein a groove is formed in an outer peripheral surface of said regulatory member.

5. The apparatus according to claim 4, wherein said groove is formed in a semi-circular shape.

6. The apparatus according to claim 4, wherein said regulatory member has a rotary shaft for its rotation, and said rotary shaft is provided at a position lower than the highest portion of said toner stirring chamber.

7. The apparatus according to claim 3, wherein said regulatory member is formed from one of plastic and metal.

8. The apparatus according to claim 3, further comprising:

a removing member for scraping said toner adhering to said regulatory member.

9. The apparatus according to claim 3, wherein said regulatory member is formed from metal.

10. The apparatus according to claim 3, wherein said regulatory member has an irregular surface.

11. An apparatus for supplying a toner, comprising:

a toner storage chamber;

a toner stirring chamber communicating with said toner storage chamber;

a rotating stirring member disposed in said toner stirring chamber; and a regulatory member disposed in said toner stirring chamber for regulating supply of said toner to said toner stirring chamber;

the toner stirring chamber being connectable to a distinct development chamber;

wherein said regulatory member has a rotational member, and wherein said toner is supplied at the amount of 10 g/minute while said regulatory member is rotated at a rotational speed of 100 rpm or less.

12. An apparatus for supplying a toner, comprising:

a toner storage chamber;

a toner stirring chamber communicating with said toner storage chamber;

a rotating toner stirring member disposed in said toner stirring chamber;

a toner supply path communicating said toner storage chamber with said toner stirring chamber;

a regulatory member arranged in said toner stirring chamber and rotating for regulating supply of said toner to said stirring chamber; and a sealing member for sealing between said regulatory member and said toner supply path;

the toner stirring chamber being connectable to a development chamber;

wherein said toner storage chamber, said toner stirring chamber, and said toner supply path are arranged to provide a scanning optical path above said regulatory member.

13. The apparatus according to claim 12, further comprising:

a removing member for scraping said toner adhering to said regulatory member.

14. The apparatus according to claim 12, wherein a groove is formed in an outer peripheral surface of said regulatory member.

15. The apparatus according to claim 14, wherein said groove is formed in a semi-circular shape.

16. The apparatus according to claim 12, wherein said sealing member has an opening for communicating said toner storage chamber with said toner storage chamber via the regulatory member.

17. The apparatus according to claim 12, wherein said regulatory member has an opening for communicating said toner storage chamber with said toner stirring chamber.

18. A development apparatus comprising:

a housing including a toner storage and a toner stirring chamber communicating with said toner storage chamber;

a rotating toner stirring member disposed in said toner stirring chamber;

a development chamber having a development roller and being supplied with said toner from said toner stirring chamber;

a regulatory member disposed in said toner stirring chamber for regulating supply of said toner to said toner stirring chamber;

wherein the development chamber is with distinct from the toner stirring chamber; and wherein a scanning optical path passing light from an optical writing member is formed in the housing above said regulatory member.

19. An image forming apparatus comprising:

said development apparatus defined in claim 18.

20. The apparatus according to claim 18, wherein a groove is formed in an outer peripheral surface of said regulatory member.

21. The apparatus according to claim 20, wherein said groove is formed in a semi-circular shape.

22. The apparatus according to claim 18, wherein said regulatory member has an irregular surface.

23. A development apparatus comprising:

a housing including a toner storage chamber, a toner stirring chamber, and a toner supply path communicating said toner storage chamber with said toner stirring chamber;

a rotating toner stirring member disposed in said toner stirring chamber;

a development chamber having a development roller and being supplied with said toner from said toner stirring chamber; and a regulatory member for regulating supply of said toner to said toner stirring chamber, wherein a scanning optical path passing light from an optical writing member is formed in a side of said toner supply chamber and above said regulatory member, wherein said regulatory member is provided in the vicinity of a port of said toner stirring chamber communicating with said toner supply path, and wherein the development chamber is distinct from the toner stirring chamber.

* * * * *